US008807732B2

(12) United States Patent
Onozawa et al.

(10) Patent No.: US 8,807,732 B2
(45) Date of Patent: Aug. 19, 2014

(54) ULTRAVIOLET IRRADIATION UNIT

(75) Inventors: Yoshiki Onozawa, Nagano (JP); Akifumi Seki, Nagano (JP); Nobuyuki Ono, Nagano (JP)

(73) Assignee: Mimaki Engineering Co., Ltd., Nagano (JP)

( * ) Notice: Subject to any disclaimer, the term of this patent is extended or adjusted under 35 U.S.C. 154(b) by 69 days.

(21) Appl. No.: 13/256,934

(22) PCT Filed: Mar. 18, 2009

(86) PCT No.: PCT/JP2009/055324

§ 371 (c)(1),
(2), (4) Date: Sep. 15, 2011

(87) PCT Pub. No.: WO2010/106655

PCT Pub. Date: Sep. 23, 2010

(65) Prior Publication Data

US 2012/0001991 A1 Jan. 5, 2012

(51) Int. Cl.
*B41J 2/01* (2006.01)

(52) U.S. Cl.
USPC ..... 347/102; 347/30; 347/34; 347/101

(58) Field of Classification Search
CPC ..... B41J 2/01; B41J 11/0015; B41J 11/002; B41M 7/0072; C09D 11/101
USPC ..... 347/30, 34, 102
See application file for complete search history.

(56) References Cited

U.S. PATENT DOCUMENTS

| | | | | |
|---|---|---|---|---|
| 7,988,280 | B2 * | 8/2011 | Noro et al. | 347/102 |
| 8,353,590 | B2 * | 1/2013 | Fujisawa | 347/102 |
| 2009/0207223 | A1 * | 8/2009 | Cofler et al. | 347/102 |
| 2011/0128336 | A1 * | 6/2011 | Onishi | 347/102 |
| 2011/0205321 | A1 * | 8/2011 | Kobayashi et al. | 347/102 |

FOREIGN PATENT DOCUMENTS

| | | | | |
|---|---|---|---|---|
| JP | 07-025007 | | 1/1995 | |
| JP | 2004-188920 | | 7/2004 | |
| JP | 2005-186422 | * | 7/2005 | B41J 2/18 |
| JP | 2005-271314 | | 10/2005 | |
| JP | 2005-324448 | | 11/2005 | |
| JP | 2008-062433 | * | 3/2008 | B41J 2/18 |
| JP | 2008-142953 | * | 6/2008 | B41J 2/01 |
| JP | 2008-168560 | | 7/2008 | |
| JP | 2008-246993 | * | 10/2008 | B41J 2/18 |

OTHER PUBLICATIONS

"Office Action of China Counterpart Application", issued on Aug. 19, 2013, with English translation thereof, p. 1-p. 15.

* cited by examiner

*Primary Examiner* — Manish S Shah
*Assistant Examiner* — Jeremy Delozier
(74) *Attorney, Agent, or Firm* — Jianq Chyun IP Office

(57) ABSTRACT

An ultraviolet irradiation unit (100) is provided with an ultraviolet irradiation device (50) and an ink mist sucking and removing device (60). The ink mist sucking and removing device (60) includes a blower fan (62), an air filter (63) and a device cover (61) for forming an air flow passage whose one end is provided with a suction port (64) located in an upper vicinity of a printing object (80) and whose another end is provided with a ventilation port (58*a*) facing an LED drive circuit board (55). Air in the upper vicinity of a printing object (80) is sucked through the suction port (64) by the blower fan (62), ink mist included in the air is removed by the air filter (63), and cleaned air discharged through the ventilation port (58*a*) is blown to an LED circuit board (51), an LED drive circuit board (55).

4 Claims, 8 Drawing Sheets

ULTRAVIOLET IRRADIATION UNIT

CROSS-REFERENCE TO RELATED APPLICATION

This application is a 371 of international application of PCT application serial no. PCT/JP2009/055324, filed on Mar. 18, 2009. The entirety of the above-mentioned patent applications is hereby incorporated by reference herein and made a part of this specification.

TECHNICAL FIELD

The present invention relates to an ultraviolet irradiation unit which is mounted on an inkjet printer for performing desired printing on a printing medium by sticking ink to the printing medium and irradiating ultraviolet rays to the ink so as to cure the ink.

BACKGROUND ART

Some of inkjet printers perform printing of a desired character, figure, pattern, photograph or the like on a printing medium by ejecting ultraviolet curing type ink having property of being cured by irradiating ultraviolet rays (hereinafter, referred to as "UV" ink) from an inkjet head. The "UV" ink is superior in weather resistance and water resistance and thus, the printed object can be used, for example, as an outdoor advertisement bill or the like and a usable application of the printed object is remarkably expanded in comparison with a case that water-soluble ink is used. As described above, an inkjet printer in which printing is performed by ejecting "UV" ink is provided with an ultraviolet irradiation device for irradiating ultraviolet rays to the "UV" ink that is stuck to a printing medium so as to cure the "UV" ink. Recently, an inkjet printer (see, for example, Japanese Patent Laid-Open No. 2004-188920) has been developed and practically used in which an ultraviolet light emitting diode (hereinafter, referred to as a "UVLED") is used as a light source for emitting ultraviolet rays (hereinafter, referred to as a "UV" light source) in the ultraviolet irradiation device.

DISCLOSURE OF THE INVENTION

Technical Problem

In various types of ink as well as the above-mentioned "UV" ink, when printing is performed on a printing medium by ejecting ink from an inkjet head, fine droplets referred to as mist (hereinafter, referred to as ink mist) may occur which floats in the inside of the printer (between the head unit and the printing medium) without sticking to the surface of the printing medium. The ink mist may cause printing medium and structure members in the printer to stain and printing quality is lowered. Especially, in an inkjet printer provided with an ultraviolet irradiation device, when the ultraviolet irradiation device is stained by sticking of ink mist, it is difficult to maintain a desired irradiation intensity.

In view of the problems described above, an objective of the present invention is to provide an ultraviolet irradiation unit in which ink mist is sucked and removed so that the ink mist is prevented from sticking to the ultraviolet irradiation device.

Solution to Problem

In order to attain the above-mentioned objective, the present invention provides an ultraviolet irradiation unit which is mounted on an inkjet printer for performing desired printing on a printing medium (for example, a printing object 80 in the embodiment) by sticking ink to the printing medium and irradiating ultraviolet rays to the ink so as to cure the ink. The ultraviolet irradiation unit is provided with an ultraviolet irradiation means (for example, the ultraviolet irradiation device 50 in the embodiment and, especially, the LED circuit board 51 (light emitting diode 51*a*) and the LED drive circuit boards 55 and 56) for irradiating ultraviolet rays to the ink which is stuck to the printing medium, and an ink mist sucking and removing device for sucking and removing ink mist floating in an upper vicinity of the printing medium. In this structure, the ink mist sucking and removing device is provided with an air flow passage forming member (for example, the device cover 61 in the embodiment) for forming an air flow passage whose one end is provided with a suction port which is located in the upper vicinity of the printing medium and whose another end is provided with a discharge port (for example, the ventilation port 58*a* in the embodiment) which faces the ultraviolet irradiation means, a blower fan which is provided in the air flow passage forming member so as to be located in the air flow passage for generating airflow which flows from the suction port to the discharge port in the air flow passage, and an air filter which is provided on an upstream side with respect to the blower fan in the air flow passage for removing ink mist included in air passing through the air flow passage. Air on the upper vicinity of the printing medium is sucked through the suction port by the blower fan so that the air is passed through the air flow passage and the ink mist included in the air is removed by the air filter and cleaned air discharged from the discharge port is blown to the ultraviolet irradiation means.

In the ultraviolet irradiation unit structured as described above, it is preferable that the air flow passage forming member is structured so that the discharge port faces an opposite side to a side of the ultraviolet irradiation means which faces the printing medium, and the cleaned air which is discharged from the discharge port is blown to the ultraviolet irradiation means and the cleaned air forms airflow which is passed through surroundings of the ultraviolet irradiation means and is directed toward the printing medium.

Further, in the ultraviolet irradiation unit, it is preferable that the ink mist sucking and removing device is provided with a cover member (for example, the LED base 52 and the device cover 58 in the embodiment) whose one end is in communication with the discharge port and whose another end is provided with an ultraviolet irradiation port (for example, the irradiation port 52*a* in the embodiment) through which ultraviolet rays emitted from the ultraviolet irradiation means are capable of passing, and the cover member covers the ultraviolet irradiation means, and the cleaned air which is discharged from the discharge port into an inside of the cover member and is blown to the ultraviolet irradiation means is discharged to an outer side through the ultraviolet irradiation port.

Further, in the ultraviolet irradiation unit structured as described above, it is preferable that the ultraviolet irradiation unit is provided with a liquid cooling device (for example, the water jackets 53*a* and 53*b* in the embodiment) which is abutted with the ultraviolet irradiation means and in which cooling liquid is circulated through an inside of the liquid cooling device for cooling the ultraviolet irradiation means.

Advantageous Effects of Invention

In the ultraviolet irradiation unit in accordance with the present invention, the ink mist sucking and removing device which is integrally disposed with the ultraviolet irradiation means is provided with an air flow passage forming member for forming an air flow passage whose one end is provided with a suction port located in an upper vicinity of the printing medium and whose another end is provided with a discharge port which faces the ultraviolet irradiation means, a blower fan which is provided in the air flow passage forming member so as to be located in the air flow passage for generating airflow which flows from the suction port to the discharge port in the air flow passage, and an air filter which is provided on an upstream side with respect to the blower fan in the air flow passage for removing ink mist included in the air passing through the air flow passage. According to this structure, ink mist occurred at the time of ink ejection is sucked through the suction port of the air flow passage forming member together with air by the blower fan and the ink mist is removed (captured) by the air filter. Therefore, a printing object and the structure members in the inside of the printer are restrained from being stained by the ink mist and lowering of printing quality due to the ink mist is also reduced. Further, the ink mist is prevented from getting closer to the ultraviolet irradiation means by blowing cleaned air to the ultraviolet irradiation means from the discharge port of the air flow passage forming member and thus sticking of the ink mist to the ultraviolet irradiation means is prevented. Further, since the cleaned air is blown to the ultraviolet irradiation means, the ultraviolet irradiation means is cooled. In addition, the ultraviolet irradiation means and the ink mist sucking and removing device are integrally structured (unitized) with each other and thus a mounting operation (positioning and the like) to an inkjet printer can be efficiently performed.

In the ultraviolet irradiation unit, it is preferable that the air flow passage forming member is structured so that the discharge port faces an opposite side to a side of the ultraviolet irradiation means which faces the printing medium, and the cleaned air which is discharged from the discharge port is blown to the ultraviolet irradiation means and the cleaned air forms airflow which is passed through surroundings of the ultraviolet irradiation means and is directed toward the printing medium. According to this structure, the ink mist floating between a printing medium and the ultraviolet irradiation means (an upper vicinity of the printing medium) is efficiently prevented from sticking (getting closer) to the ultraviolet irradiation means by airflow directing toward the printing medium.

Further, in the ultraviolet irradiation unit, it is preferable that the ink mist sucking and removing device is provided with a cover member whose one end is in communication with the discharge port and whose another end is provided with an ultraviolet irradiation port through which ultraviolet rays emitted from the ultraviolet irradiation means are capable of passing, and the cover member covers the ultraviolet irradiation means, and the cleaned air which is discharged from the discharge port into an inside of the cover member and is blown to the ultraviolet irradiation means is discharged to an outer side through the ultraviolet irradiation port. According to this structure, the ink mist is surely prevented from sticking to the ultraviolet irradiation means, especially to an emitting part of the ultraviolet irradiation means, by the airflow discharged from the ultraviolet irradiation port. Therefore, lowering of the irradiation intensity from the ultraviolet irradiation means due to sticking of the ink mist is prevented.

Further, in the ultraviolet irradiation unit, it is preferable that the ultraviolet irradiation unit is provided with a liquid cooling device which is abutted with the ultraviolet irradiation means and in which cooling liquid is circulated through an inside of the liquid cooling device for cooling the ultraviolet irradiation means. According to this structure, air cooling by using the ink mist sucking and removing device (blowing of cleaned air) and liquid cooling by using a liquid cooling device are used together and thus cooling performance in the ultraviolet irradiation unit is remarkably improved.

DESCRIPTION OF EMBODIMENTS

Figure 2:
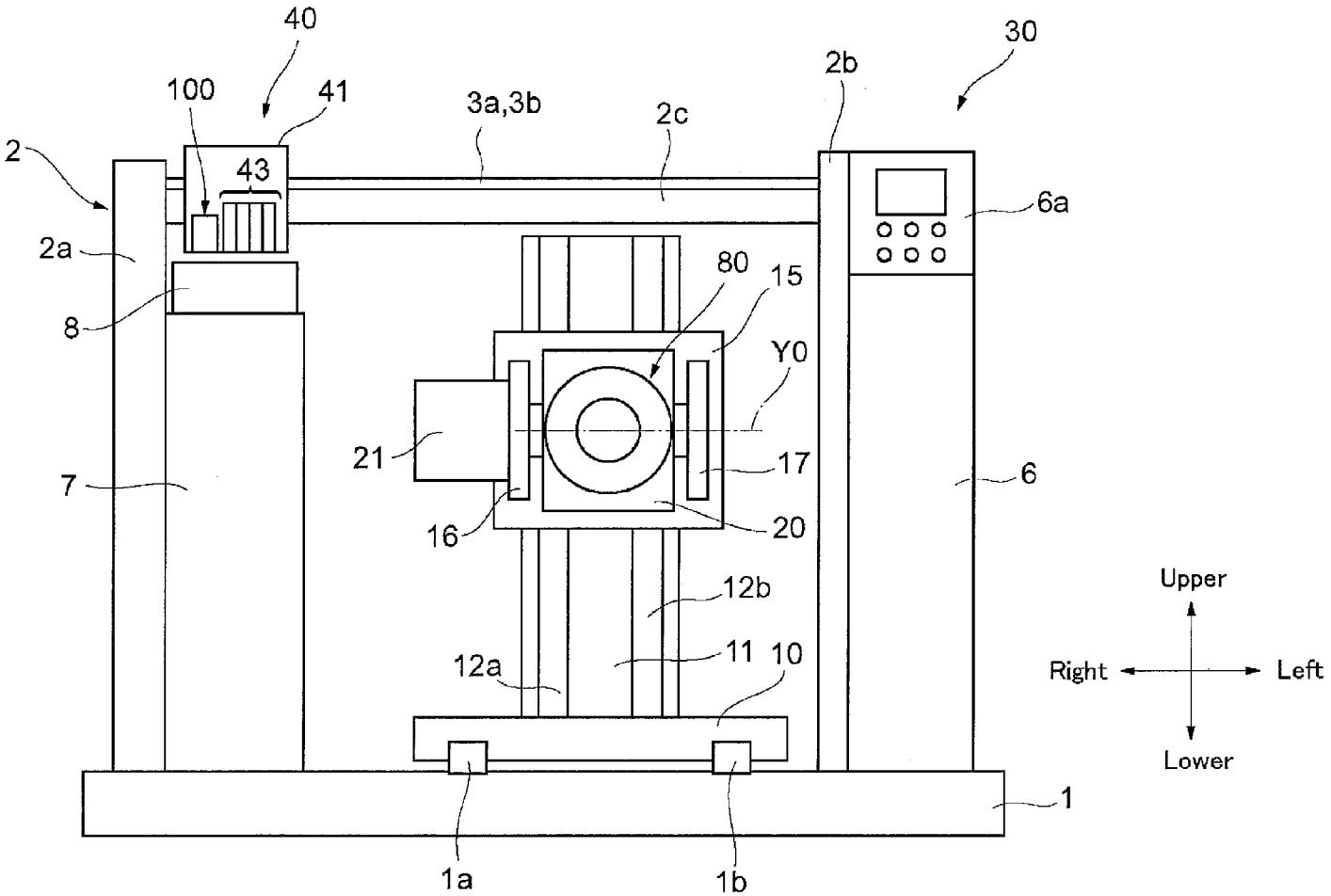
FIG. 2 is a front view showing an inkjet printer which is provided with the ultraviolet irradiation unit.
Figure 3:
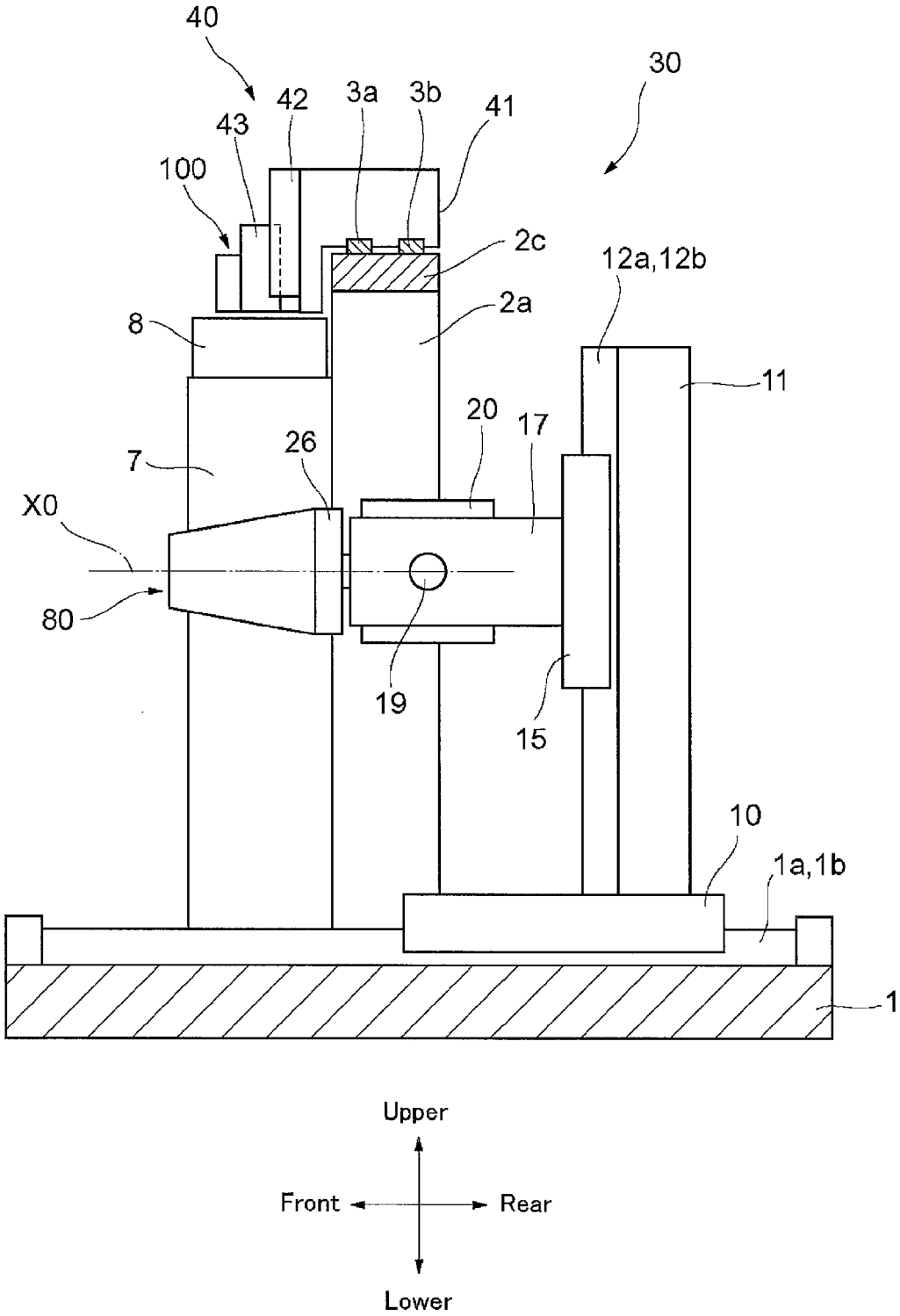
FIG. 3 is a side view (partly cross-sectional view) showing the inkjet printer.
Figure 4:
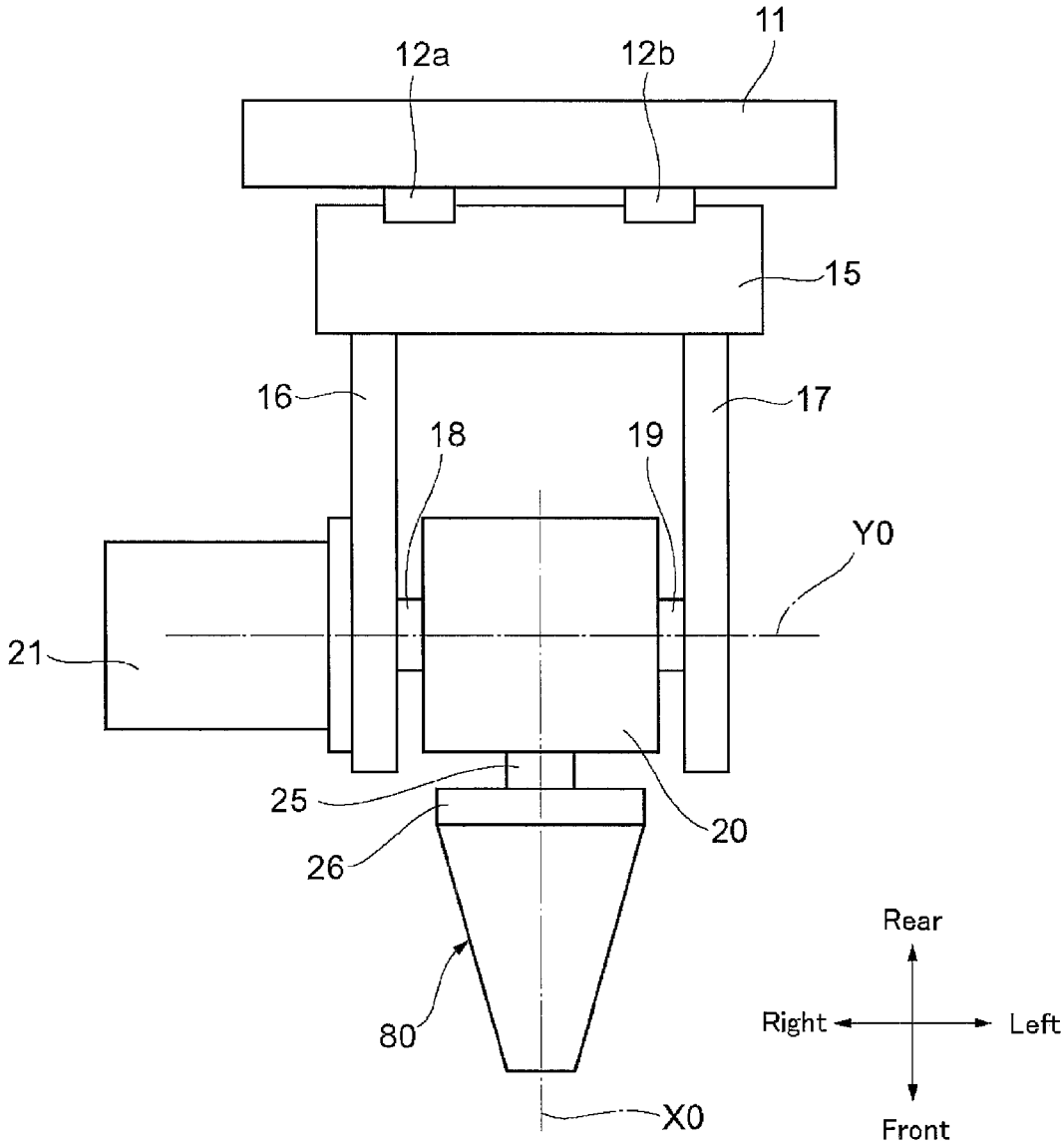
FIG. 4 is a plan view showing a part of the inkjet printer.

A preferred embodiment of the present invention will be described below with reference to the accompanying drawings. The present embodiment which will be described below is a structural example in which the present invention is applied to a three-dimensional printer which is capable of printing on a printing object having a surface in a three-dimensional shape (for example, a cylindrical, a hemispherical or a spherical shape or the like). First, an entire structure of a three-dimensional printer 30 will be described below with reference to FIGS. 2 through 4. FIG. 2 is a front view showing the three-dimensional printer 30, FIG. 3 is a side view (partly cross-sectional view) showing the three-dimensional printer 30, and FIG. 4 is a plan view showing a part of the three-dimensional printer. In the following description, directions of the arrows in the drawings are respectively defined as front and rear, right and left, and upper and lower for convenience of description.

In the three-dimensional printer 30, a gate type support frame 2 which is structured of a pair of right and left support legs 2*a* and 2*b* and a support beam 2*c* extended in a right and left direction so as to connect upper ends of the support legs 2*a* and 2*b* with each other is fixed on a base 1. Further, a first control device 6 having an operation panel 6*a* is provided on the base 1 so as to be adjacent to the left support leg 2*b* and a second control device 7 having a maintenance station 8 is provided on the base 1 so as to be adjacent to the right support leg 2*a*. The first and the second control devices 6 and 7 are comprised of various control devices such as a movement control device for performing control of movement and rotating operation of various members described below, a printer control device and the like for performing ink ejection control from an inkjet head and a power supply control device and the like.

A pair of right and left guide rails 3*a* and 3*b* is provided on an upper face of the support beam 2*c* in a front and rear direction so as to extend in the right and left direction (Y-axis direction) and a print part 40 is attached on the guide rails 3*a* and 3*b* so as to be movable in the right and left direction. In order to move a carriage 41 structuring the print part 40 in the right and left direction with respect to the support beam 2*c*, a carriage moving mechanism (not shown) such as a ball screw mechanism is provided in the inside of the support beam 2*c*, and movement in the right and left direction of the carriage 41 (print part 40) is controlled by controlling the drive of the carriage moving mechanism. The carriage moving mechanism is structured by using a well-known moving mechanism and thus description of its structure is omitted.

In addition, a pair of front and rear guide rails 1*a* and 1*b* extended in the front and rear direction ("X"-axis direction) is provided on the base 1 so as to be located between the right and left support legs 2*a* and 2*b* of the gate type support frame 2. A first support member 10 is provided on the front and rear guide rails 1*a* and 1*b* so as to be movable in the front and rear direction. A perpendicular support member 11 is fixed on the first support member 10 in a perpendicularly standing state and a pair of vertical guide rails 12*a* and 12*b* extending in a perpendicular direction ("Z" direction) is provided on a front face of the perpendicular support member 11. A second support member 15 is supported by the vertical guide rails 12*a* and 12*b* and is movable in an upper and lower direction. In order to move the first support member 10 in a front and rear direction with respect to the base 1 and, in order to move the second support member 15 in the upper and lower direction with respect to the perpendicular support member 11, a feed mechanism such as a ball screw mechanism is provided in respective insides of the base 1 and the perpendicular support member 11. Movements of the first support member 10 and the second support member 15 are respectively controlled by controlling of drives of the feed mechanisms. The feed mechanism is also structured of a well-known feed mechanism and thus description of its structure is omitted.

A pair of right and left support arms 16 and 17 is fixed on a front face side of the second support member 15 so as to be extended in the front and rear direction. In addition, a third support member 20 is turnably supported between the support arms 16 and 17 by a pair of right and left drive shafts 18 and 19 horizontally extended from both end parts of the right and left support arms 16 and 17 so that the third support member 20 is turnable with a first rotation axis "Y0" extended in the "Y"-axis direction as a turning center. An output shaft (not shown) of a drive motor 21 which is attached to an outer side wall of the support arm 16 is coupled to the right side drive shaft 18. Therefore, when the drive motor 21 is rotationally driven, a rotational drive force is transmitted to the drive shaft 18 connected to the drive motor 21 and the third support member 20 can be turned with the first rotation axis "Y0" as a turning center.

A holding shaft 25 is extended in the front and rear direction from the front face side of the third support member 20, is rotatably provided with a second rotation axis "X0" extending in the front and rear direction as a rotating center and is protruded to the front side. A holding chuck 26 for holding a printing object 80 is attached to the front end of the holding shaft 25. The holding shaft 25 is rotationally driven and controlled by a drive motor (not shown) which is disposed in the inside of the third support member 20 that is formed in a bottomed rectangular tube shape. The holding chuck 26 is structured so as to be capable of holding a printing object 80. Therefore, when the holding shaft 25 is rotationally driven in a state that the printing object 80 is held by the holding chuck 26, the printing object 80 is rotated with the second rotation axis "X0" as a center.

Next, structure of the print part 40 will be described below with reference to FIGS. 1(*a*) and 1(*b*), and FIGS. 5 through 8). In FIGS. 8(*a*) and 8(*b*), a device cover 58 structuring the ultraviolet irradiation device 50 and a device cover 61 structuring the ink mist sucking and removing device 60 are shown as transparent members for clearly showing structure members and airflow in the insides of the device covers 58 and 61 and thus, actually, the device covers 58 and 61 are not required to be transparent. Further, for clearly showing the airflow, in FIGS. 8(*a*) and 8(*b*), a blower fan 62 structuring the ink mist sucking and removing device 60 is not shown. Further, in FIG. 1(*a*), ink droplets ejected from ejection nozzles of the inkjet head 43 are schematically shown with white circles and ink mist occurred with the ink droplets is schematically shown with black points.

Figure 5:
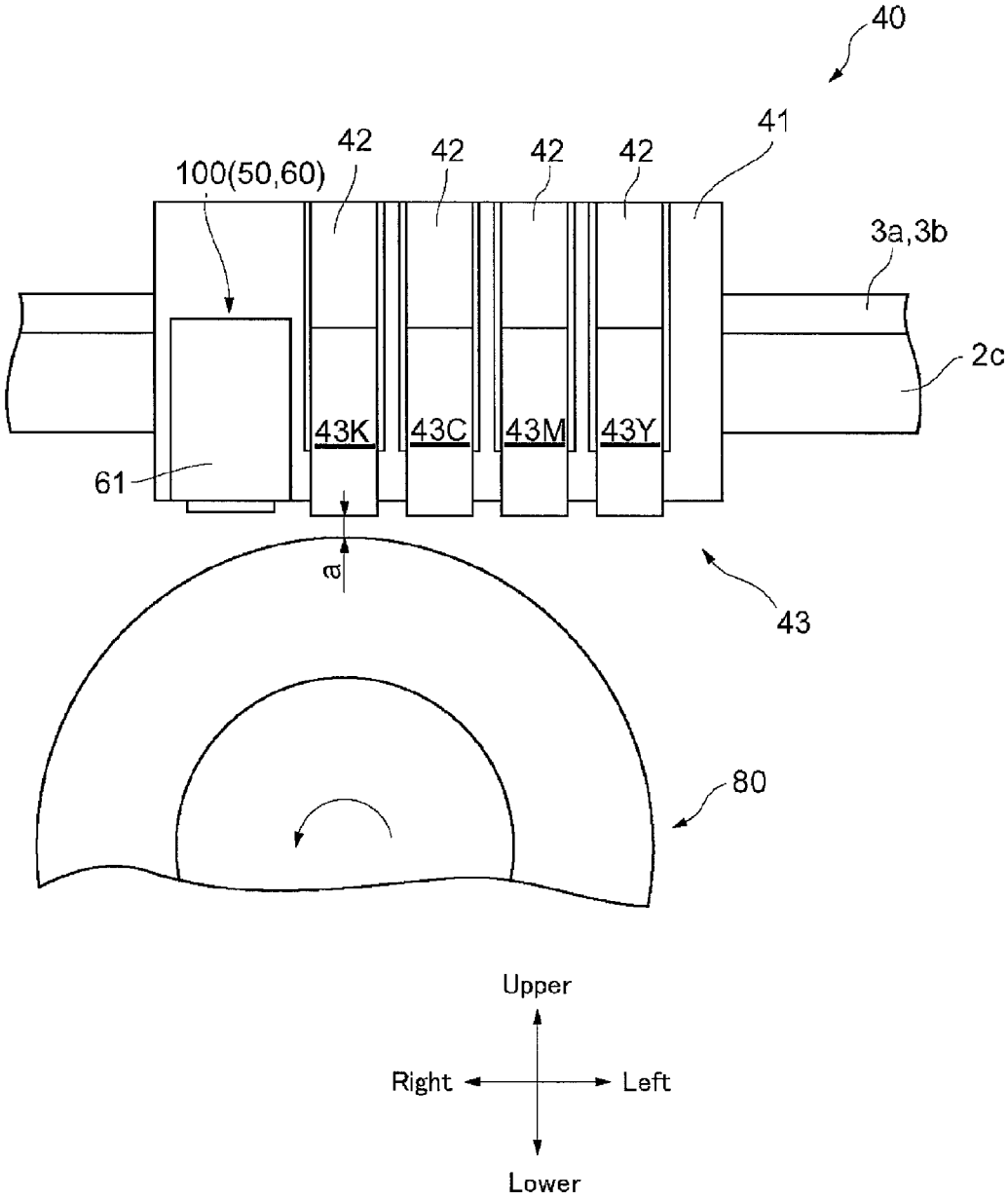
FIG. 5 is a front view showing a print part which structures the inkjet printer.
Figure 6:
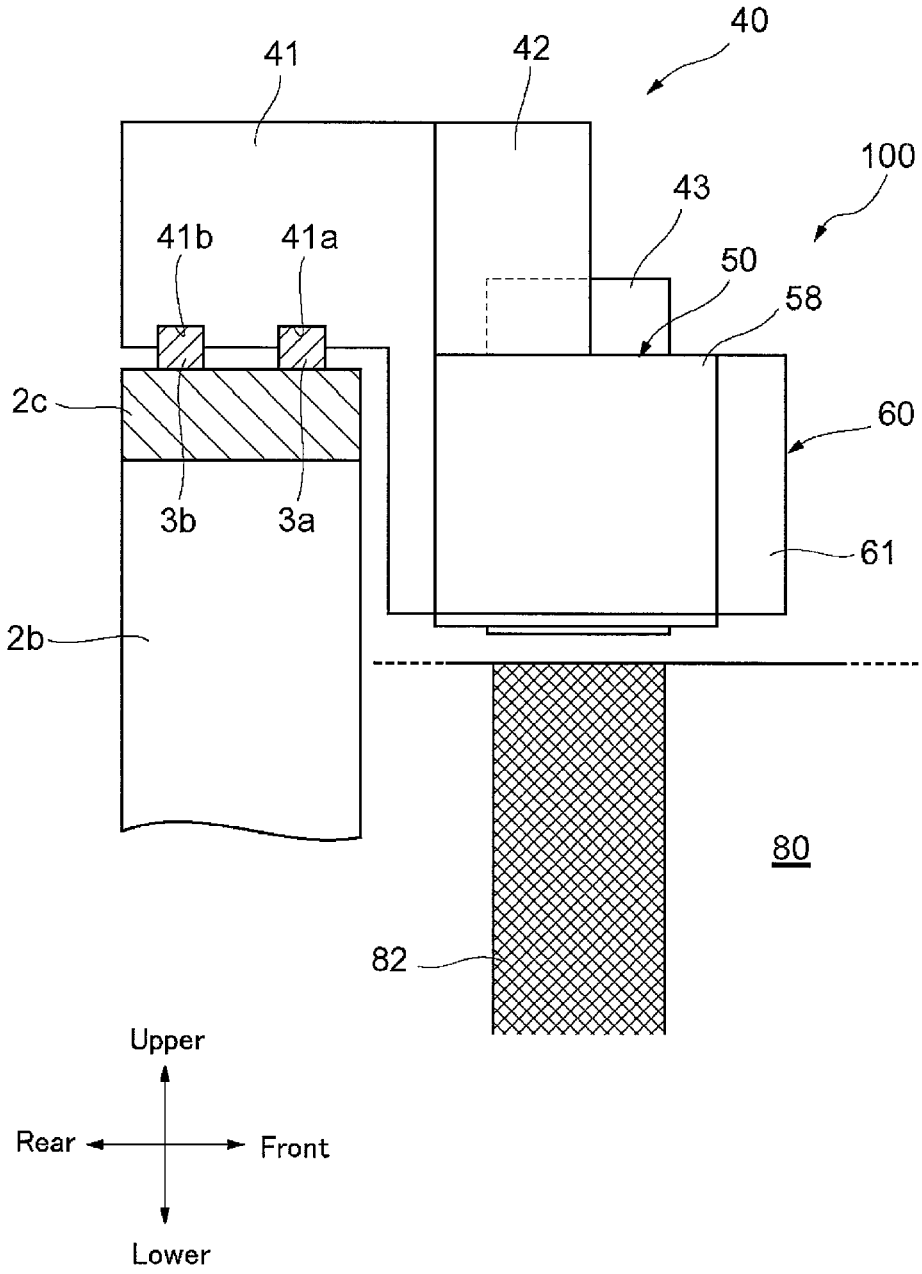
FIG. 6 is a side view (partly cross-sectional view) showing the print part which is viewed from the right side.

The print part 40 is, as shown in FIGS. 5 and 6, mainly structured of a carriage 41, an inkjet head 43, a head holding device 42, and an ultraviolet irradiation unit 100 comprised of an ultraviolet irradiation device 50 and an ink mist sucking and removing device 60. The carriage 41 is a substantially "L"-shaped member which is extended to the front side from a portion supported by the right and left guide rails 3*a* and 3*b* and is bent to the lower side. The inkjet head 43 is attached to the front face of the carriage 41 through the head holding device 42. Further, the ultraviolet irradiation device 50 is attached on the front face of the carriage 41 so as to be adjacent to the right side of the inkjet head 43.

The inkjet head 43 is, for example, structured of a plurality of inkjet heads 43K, 43C, 43M and 43Y which are juxtaposed in the right and left direction so as to correspond to ultraviolet curing type inks (hereinafter, referred to as "UV" ink) of different colors like black (K), cyan (C), magenta (M) and yellow (Y). A plurality of ejection nozzles (not shown) is formed on an under face of each of the inkjet heads 43 and "UV" ink can be ejected from the ejection nozzle toward a lower side.

The head holding device 42 is attached to a front face of the carriage 41 so as to correspond to the respective inkjet heads 43 (43K, 43C, 43M and 43Y) and is structured so as to sandwich and hold the inkjet head 43 from the right and left sides. The head holding device 42 is, for example, provided with a feed mechanism such as a ball screw mechanism and is structured to support each of the inkjet heads 43 so as to be independently movable in an upper and lower direction to a desired position with respect to the carriage 41 by controlling drive of the feed mechanism.

Figure 1A:
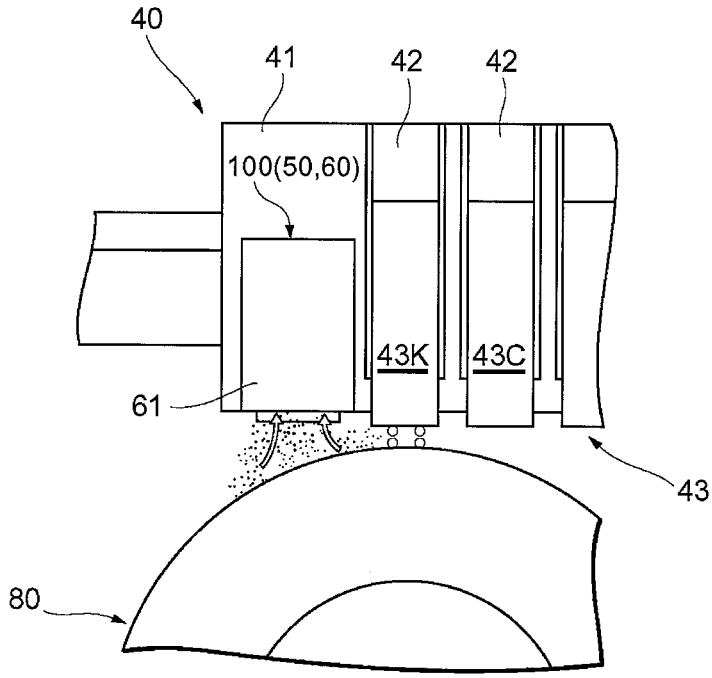
FIG. 1(*a*) is a front view showing an ultraviolet irradiation unit in accordance with the present invention which is disposed in an inkjet printer, and FIG. 1(*b*) is a side view (partly cross-sectional view) showing the ultraviolet irradiation unit.
Figure 1B:
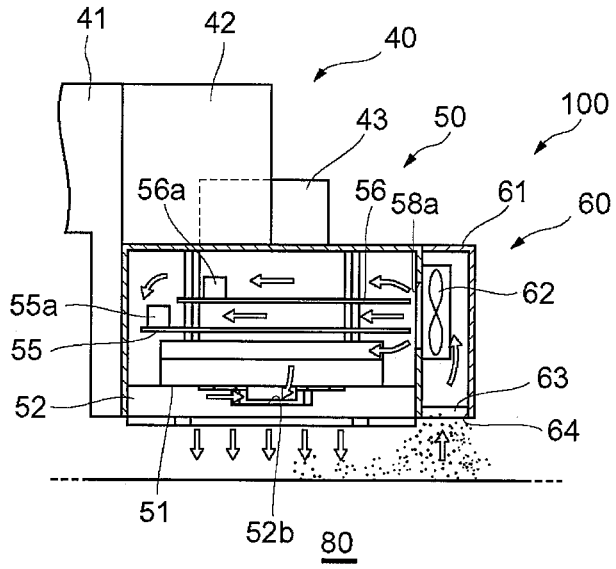
Figure 7A:
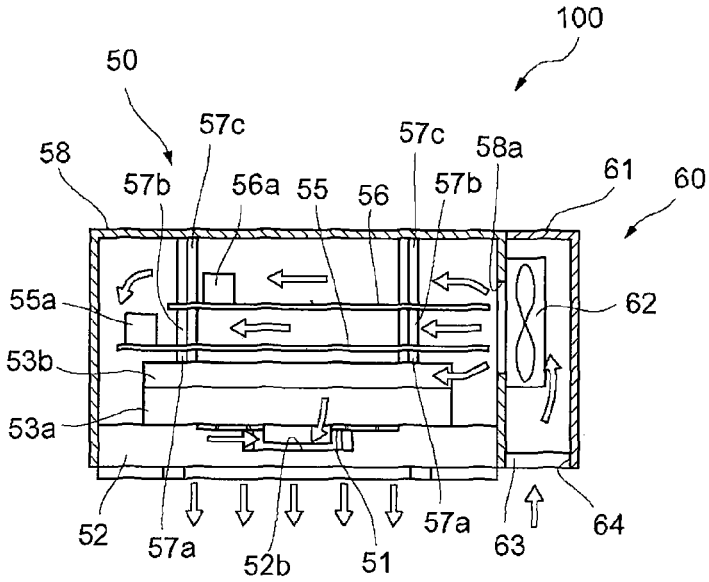
FIG. 7(*a*) is a side view (partly cross-sectional view) showing the ultraviolet irradiation unit and FIG. 7(*b*) is a bottom view showing the ultraviolet irradiation unit.
Figure 7B:
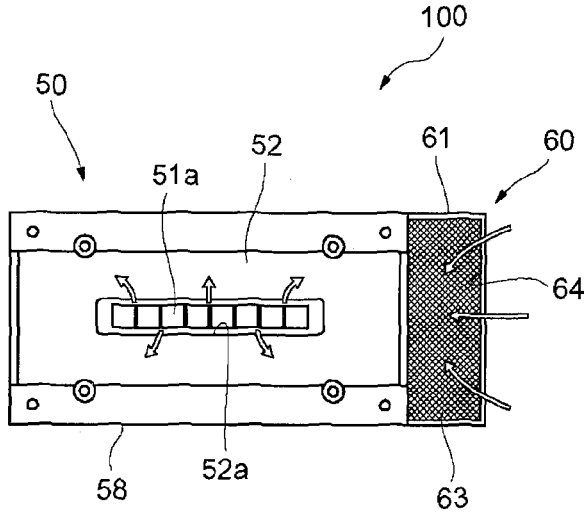
Figure 8A:
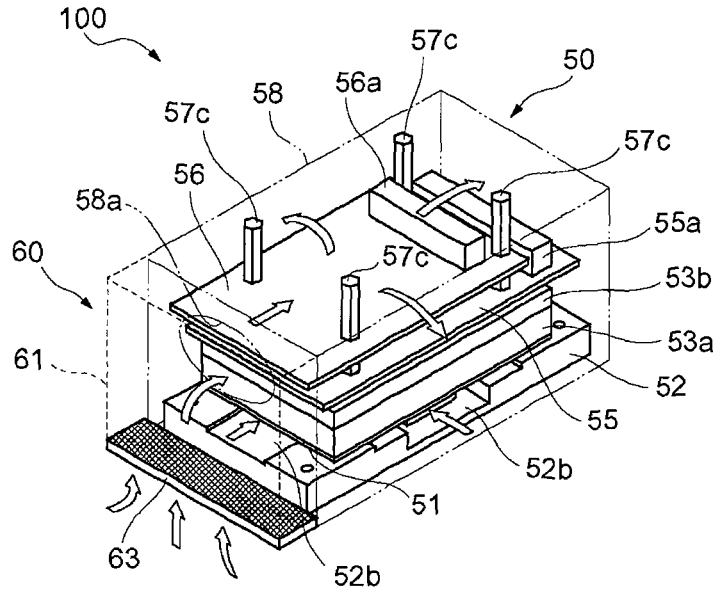
FIG. 8(*a*) is a perspective view showing the ultraviolet irradiation unit (partly not shown) which is viewed from the front side, and FIG. 8(*b*) is a perspective view showing the ultraviolet irradiation unit (partly not shown) which is viewed from the rear side.
Figure 8B:
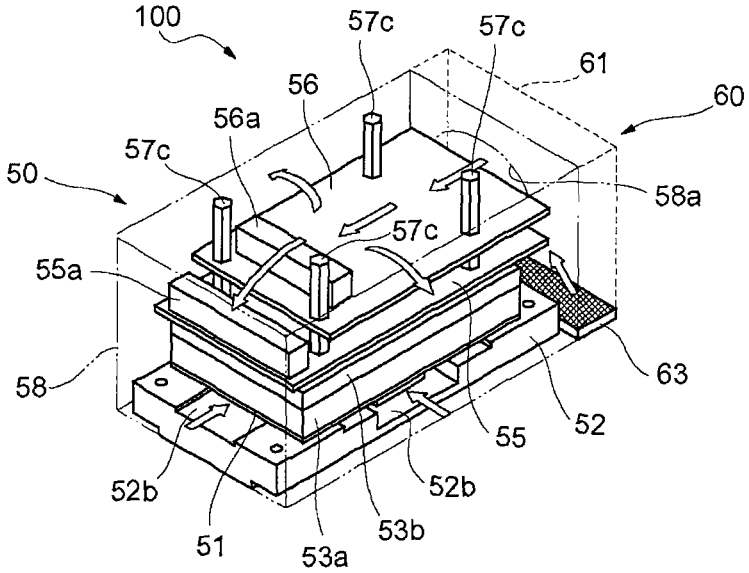

The ultraviolet irradiation unit 100 is, as shown in FIGS. 1(*a*) and 1(*b*), FIGS. 7(*a*) and 7(*b*) and FIGS. 8(*a*) and 8(*b*), structured of the ultraviolet irradiation device 50 and the ink mist sucking and removing device 60 in a unitized state. The ultraviolet irradiation device 50 is, as described above, attached to the front face of the carriage 41 so as to be adjacent to the inkjet head 43 (inkjet head 43K located on the most right side). The ultraviolet irradiation device 50 is mainly structured of an LED circuit board 51, an LED base 52, a first and a second water jackets 53*a* and 53*b*, a first and a second LED drive circuit boards 55 and 56, and a device cover 58. The LED circuit board 51 is structured so that a plurality of light emitting diodes 51*a* (eight diodes in this embodiment) as a ultraviolet light source which is capable of emitting ultraviolet rays (hereinafter, referred to as a UVLED 51*a*) is juxtaposed in a single line in the front and rear direction and the LED circuit board 51 is attached on the LED base 52 in a state that the UVLEDs 51*a* are directed to a lower side.

The LED base 52 is formed in a substantially rectangular plate shape and an irradiation port 52*a* penetrating in the upper and lower direction is formed at a center part of the LED base 52 so as to extend in the front and rear direction. Ultraviolet rays irradiated from the UVLEDs 51*a* of the LED circuit board 51 are irradiated downward through the irradiation port 52*a*. Ventilation recessed parts 52*b* are respectively formed on an upper face of the LED base 52 so as to be extended from its front and rear side faces and its right and left side faces to the irradiation port 52*a*. Therefore, air can be circulated between an inside space of the ultraviolet irradiation device 50, which is formed by attaching of the device cover 58 to the LED base 52, and the outside of the device through the irradiation port 52*a* and the respective ventilation recessed parts 52*b*. The device cover 58 is formed in a substantially rectangular box-like shape whose lower side is opened. The device cover 58 is attached to the LED base 52 so as to close the opening provided on its lower side with the LED base 52 to form a closed inside space above the LED base 52. A ventilation port 58*a* is formed in a side face on the front side of the device cover 58 so as to penetrate through the side face on the front side.

A first water jacket 53*a* is provided on the LED circuit board 51 so as to be abutted with the circuit board 51 and a second water jacket 53*b* is provided on the first water jacket 53*b*. The first and the second water jackets 53*a* and 53*b* are formed with flow passages so that cooling liquid is circulated in their insides. The cooling liquid cooled by a cooling device not shown is supplied by a liquid feed pump not shown through a liquid feed hose and the LED circuit board 51 and the UVLEDs 51*a* are cooled by circulating the cooling liquid through the first and second water jackets 53*a* and 53*b*. The cooling liquid heated by passing through the water jackets 53*a* and 53*b* is returned to the cooling device and is cooled again and then the cooling liquid is supplied to the water jackets 53*a* and 53*b* again.

A first LED drive circuit board 55 is a circuit board for controlling a voltage supplied from a power source not shown to drive the UVLEDs 51*a* of the LED circuit board 51. The first LED drive circuit board 55 is provided on an upper face of the second water jacket 53*b* through a predetermined interval by using four support pieces 57*a*. A second LED drive circuit board 56 is, similarly to the first LED drive circuit board 55, a circuit board for driving the UVLEDs 51*a* and is provided on an upper face of the first LED drive circuit board 55 through a predetermined interval by using four support pieces 57*b*. Four support pieces 57*c* are also provided between an upper face of the second LED drive circuit board 56 and a top plate of the device cover 58 and a space having a predetermined interval is provided between the upper face of the second LED drive circuit board 56 and the top plate of the device cover 58.

The ink mist sucking and removing device 60 is mainly structured of a device cover 61, a blower fan 62 and an air filter 63 and is disposed on a front face of the device cover 58 of the ultraviolet irradiation device 50. The device cover 61 is attached to a front face of the device cover 58 so as to cover the ventilation port 58*a* and to form an internal space between the device cover 58 and the device cover 61. A suction port 64 which is opened downward is formed at a lower end of the internal space. The blower fan 62 is attached to the device cover 58 so as to close the ventilation port 58*a* and the blower fan 62 is a device for flowing air into the inside of the ultraviolet irradiation device 50 (device cover 58), specifically, a device for sucking the outside air into the inside of the device cover 61 through the suction port 64 to flow into the inside of the device cover 58 from the ventilation port 58*a* through itself (blower fan 62). The blower fan 62 is driven by a fan drive mechanism not shown.

An air filter 63 is disposed on an upstream side with respect to the blower fan 62 in the inside of the device cover 61 (vicinity of the suction port 64 in this embodiment). The air filter 63 is required to provide with such roughness that does not prevent flowing of air which is sucked into the inside of the device cover 61 by the blower fan 62 and such fineness that is capable of capturing (removing) ink mist. The air filter 63 is, for example, formed in a mesh-like shape having such roughness and fineness.

In the three-dimensional printer 30 which is structured as described above, when printing is to be performed on a printing object 80 which is held by the holding chuck 26, "UV" inks are stuck to a surface of the printing object 80 one by one to perform a desired printing. In this embodiment, as an example, a printing operation of the three-dimensional printer 3 will be briefly described below in which, after a "UV" ink of black is firstly stuck to the surface of the printing object 80, "UV" inks of cyan, magenta and yellow are stuck to the surface in this order to perform printing. When the "UV" inks are stuck to the printing object 80 one by one as described above, an under face of the inkjet head 43 ejecting the "UV" ink and the surface of the printing object 80 are oppositely disposed with a high degree of accuracy. Therefore, the ejected ink is capable of being stuck to an ejection position as controlled and thus a high-quality printing can be attained.

First, as shown in FIG. 5, movement controls of the respective structure members are performed by the movement control device so that a surface of a printing object 80 and an under face of the inkjet head 43K (face where a plurality of ejection nozzles is formed) are oppositely disposed to each other and its interval is set to be a predetermined printing interval "a". Then, ink ejection from the inkjet head 43K and rotation in the counterclockwise direction of the printing object 80 in the front view are synchronously controlled and ultraviolet rays are irradiated from the ultraviolet irradiation device 50 (UVLEDs 51*a*). In this manner, the "UV" ink of black is stuck on the surface of the printing object 80 and the "UV" ink is cured to such an extent that the "UV" ink is not blurred and a belt-shaped printing region 82 is formed (see FIG. 6). The printing interval "a" is set to be an optimum interval which is capable of attaining a high-quality printing depending on, for example, characteristics (viscosity and the like) of the "UV" ink, the surface condition of the printing object, and the like.

Next, the carriage 41 is slide-moved with respect to the support beam 2*c* in the right and left direction by the carriage moving mechanism and the inkjet head 43C is moved in the upper and lower direction with respect to the carriage 41 by the head holding device 42 so that the under face of the inkjet head 43C and the surface of the printing object 80 are oppositely disposed to each other through the printing interval "a". Then, similarly to the case of the inkjet head 43K, ink ejection from the inkjet head 43C and rotation in the counterclockwise direction of the printing object 80 are synchronously controlled and ultraviolet rays are irradiated from the ultraviolet irradiation device 50. As a result, the "UV" ink of cyan is stuck on the printing region 82 and the "UV" ink is cured to such an extent that the "UV" ink is not blurred.

Then, similarly to the case of the inkjet head 43C, drive controls of the carriage moving mechanism and the head holding device 42 are performed so that the under face of the inkjet head 43M and the surface of the printing object 80 are oppositely disposed to each other through the printing interval "a". After that, ink ejection from the inkjet head 43M and rotation of the printing object 80 are synchronously controlled and ultraviolet rays are irradiated from the ultraviolet irradiation device 50. In this manner, the "UV" ink of magenta is stuck on the printing region 82 and the "UV" ink is cured to such an extent that the "UV" ink is not blurred. In addition, similarly in the case of the inkjet head 43Y, after the under face of the inkjet head 43Y is set to be oppositely disposed to the surface of the printing object 80 through the printing interval "a", the "UV" ink of yellow is stuck on the printing region 82 and the "UV" ink is cured to such an extent that the "UV" ink is not blurred. As a result, printing to the printing region 82 is completed. Such printing is performed on the entire surface by moving the printing object 80 in the front and rear direction and an image such as a character and a figure corresponding to a printing program is formed on the surface of the printing object 80.

When printing is to be performed on the surface of a printing object 80 by ejecting "UV" ink from ejection nozzles of the inkjet head 43 as described above, ink mist may occur which is not stuck on the surface of the printing object 80 and floats a space between the under face of the inkjet head 43 and the printing object 80 (upper space of the printing object). The printing object 80 and printer structure members such as the ultraviolet irradiation device 50 may be stained by the ink mist to cause to lower the printing quality. Especially, when the ultraviolet irradiation device 50 is stained due to sticking of the ink mist, it is difficult to maintain the desired irradiation intensity.

In order to solve the problem caused by the ink mist, the ultraviolet irradiation unit 100 which is mounted on the three-dimensional printer 30 is provided with the ink mist sucking and removing device 60. An operation of the ink mist sucking and removing device 60 will be described below. The operation of the ink mist sucking and removing device 60 is started before ink ejections from nozzles of each of the inkjet heads 43 are started (or simultaneously operated at the start of the ink ejection). In the ink mist sucking and removing device 60, air is sucked through the suction port 64 of the device cover 61 by the blower fan 62 and airflow is generated which is directed to the suction port 64 from a side of the printing object 80 supported by the holding chuck 26. Therefore, the ink mist occurred in association with ink droplets ejected from the inkjet head 43 is immediately sucked into the inside of the device cover 61 by the airflow through the suction port 64 and is removed (captured) by the air filter 63 without floating in the upper space of the printing object 80. Accordingly, the printing object 80 and the structure members of the printer are restrained from being stained by the ink mist and lowering of printing quality due to the ink mist is also reduced.

The air which is sucked into the inside of the device cover 61 through the suction port 64 by the blower fan 62 flows into the inside of the ultraviolet irradiation device 50 through the ventilation port 58*a* of the device cover 58 and the air flows through various passages, e.g., above the first LED drive circuit board 55 or above the second LED drive circuit board 56 to be blown out toward the printing object 80 through the ventilation recessed parts 52*b* and the irradiation port 52*a* of the LED base 52. In this case, the air which is flowed into the inside of the device cover 58 hits electronic components 55*a* and 56*a* disposed on the first and the second LED drive circuit boards 55 and 56, the UVLEDs 51*a* and the like to provide a cooling effect. Lowering of the irradiation intensity due to temperature rises of the UVLEDs 51*a* and the respective drive circuit boards 55 and 56 is prevented by using liquid cooling by the first and the second water jackets 53*a* and 53*b* together with the air cooling. Further, the ink mist is prevented from passing through the irradiation port 52*a* and sticking to the irradiation face of the UVLEDs 51*a* by the airflow blown out toward the printing object 80 through the irradiation port 52*a* and thus lowering of the irradiation intensity due to sticking of the ink mist is also prevented. In addition, the ultraviolet irradiation device 50 and the ink mist sucking and removing device 60 are integrally structured (unitized) with each other and thus a mounting operation (positioning and the like) to the three-dimensional printer 30 can be efficiently performed.

In the embodiment described above, the ink mist sucking and removing device 60 is disposed on the front side of the ultraviolet irradiation device 50 but the present invention is not limited to this arrangement structure. For example, the ink mist sucking and removing device 60 may be disposed on the left side of the ultraviolet irradiation device 50 (side which faces the inkjet head 43K) or may be disposed on the right side of the ultraviolet irradiation device 50. Further, in the embodiment described above, the device cover 58 of the ultraviolet irradiation device 50 and the device cover 61 of the ink mist sucking and removing device 60 may be integrally structured as one member. Further, in the embodiment described above, the suction port 64 is provided so as to face the printing object 80 but it is preferable that the suction port 64 is provided so as to be capable of efficiently sucking the occurred ink mist.

Further, in the embodiment described above, the ultraviolet irradiation device 50 is structured so as to provide with the LED base 52 and the device cover 58 which cover surroundings of the LED circuit board 51 (UVLEDs 51*a*), the LED drive circuit boards 55 and 56 and the like. However, the ultraviolet irradiation device 50 may be structured without using the device cover 58 and the like. Also in this case, ink mist is prevented from getting closer to the ultraviolet irradiation device 50 by airflow which is blown by the ink mist sucking and removing device 60 and thus sticking of the ink mist to the ultraviolet irradiation device 50 can be prevented.

Further, in the embodiment described above, the ventilation port 58*a* is disposed on the front side of the ultraviolet irradiation device 50 but the arrangement of the ventilation port 58*a* may be modified appropriately. For example, when the ventilation port 58*a* is disposed on an upper side of the ultraviolet irradiation device 50, airflow is formed so as to pass surroundings of the ultraviolet irradiation device 50 toward the printing object 80 and thus ink mist floating in the upper vicinity of the printing object 80 can be efficiently prevented from sticking to the ultraviolet irradiation device 50 by this airflow.

Further, the ultraviolet irradiation unit in accordance with the present invention may be structured so as to be unitized with a moving member (for example, the carriage 41 in the above-mentioned embodiment) which is relatively movable with respect to a printing object. Further, in the embodiment described above, as an example of an inkjet printer, the present invention is applied to a three-dimensional printer which is capable of printing on a printing object having a surface in a three-dimensional shape. However, the present invention may be applied to an inkjet printer which performs printing on a flat face.

What is claimed is:

1. An ultraviolet irradiation unit which is mounted on an inkjet printer for performing desired printing on a printing medium by sticking ink to the printing medium and irradiating ultraviolet rays to the ink so as to cure the ink, the ultraviolet irradiation unit comprising:

an ultraviolet irradiation means for irradiating ultraviolet rays to the ink which is stuck to the printing medium;

an ink mist sucking and removing device for sucking and removing ink mist floating in an upper vicinity of the printing medium;

wherein the ink mist sucking and removing device comprises;

an air flow passage forming member for forming an air flow passage whose one end is provided with a suction port which is located in the upper vicinity of the printing medium and whose another end is provided with a discharge port which faces the ultraviolet irradiation means; wherein the air flow passage forming member is structured so that the discharge port faces an opposite side to a side of the ultraviolet irradiation means which faces the printing medium;

a blower fan which is provided in the air flow passage forming member so as to be located in the air flow passage for generating airflow which flows from the suction port to the discharge port in the air flow passage; and an air filter which is provided on an upstream side with respect to the blower fan in the air flow passage for removing ink mist included in air passing through the air flow passage; and wherein air in the upper vicinity of the printing medium is sucked through the suction port by the blower fan so that the air is passed through the air filter and the ink mist included in the air is removed by the air filter and becomes a cleaned air, the cleaned air discharged from the discharge port is blown to the ultraviolet irradiation means, and forms airflow which is passed through surroundings of the ultraviolet irradiation means and is directed toward the printing medium, and a movement control device for controlling an inkjet head and the printing medium, wherein ink ejection from the inkjet head and rotation of the printing medium are synchronously controlled and ultraviolet rays are irradiated from the ultraviolet irradiation device, wherein the printing medium has a surface in a three-dimensional shape.

2. The ultraviolet irradiation unit according to claim 1, wherein the ink mist sucking and removing device is provided with a cover member whose one end is in communication with the discharge port and whose another end is provided with an ultraviolet irradiation port through which ultraviolet rays emitted from the ultraviolet irradiation means are capable of passing, and the cover member covers the ultraviolet irradiation means, and the cleaned air which is discharged from the discharge port into an inside of the cover member and is blown to the ultraviolet irradiation means is discharged to an outer side through the ultraviolet irradiation port.

3. The ultraviolet irradiation unit according to claim 1, further comprising a liquid cooling device which is abutted with the ultraviolet irradiation means and in which cooling liquid is circulated through an inside of the liquid cooling device for cooling the ultraviolet irradiation means.

4. The ultraviolet irradiation unit according to claim 2, further comprising a liquid cooling device which is abutted with the ultraviolet irradiation means and in which cooling liquid is circulated through an inside of the liquid cooling device for cooling the ultraviolet irradiation means.

* * * * *